US010024269B2

(12) United States Patent
Nodl

(10) Patent No.: US 10,024,269 B2
(45) Date of Patent: Jul. 17, 2018

(54) PISTON FOR AN INTERNAL COMBUSTION ENGINE

(75) Inventor: Martin Nodl, Nuremberg (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 726 days.

(21) Appl. No.: 12/999,719

(22) PCT Filed: Apr. 22, 2009

(86) PCT No.: PCT/EP2009/054816

§ 371 (c)(1),
(2), (4) Date: Mar. 4, 2011

(87) PCT Pub. No.: WO2009/153088

PCT Pub. Date: Dec. 23, 2009

(65) Prior Publication Data

US 2011/0168124 A1 Jul. 14, 2011

(30) Foreign Application Priority Data

Jun. 19, 2008 (DE) ..... 10 2008 002 536

(51) Int. Cl.
*F02F 3/00* (2006.01)
*F02F 3/02* (2006.01)

(52) U.S. Cl.
CPC ..... *F02F 3/022* (2013.01)

(58) Field of Classification Search
CPC ..... F05C 2201/021; F02B 3/06; F02F 3/22; F02F 3/00
USPC ..... 123/193.6, 193.4; 92/233, 208, 186
See application file for complete search history.

(56) References Cited

U.S. PATENT DOCUMENTS

| | | | | |
|---|---|---|---|---|
| 2,149,862 | A * | 3/1939 | Nelson | F02F 3/042 92/228 |
| 4,831,919 | A * | 5/1989 | Bruni | 92/233 |
| 5,000,078 | A | 3/1991 | Gabele | |
| 5,299,490 | A * | 4/1994 | Harrer et al. | 92/208 |
| 6,345,569 | B1 * | 2/2002 | Take | F02F 3/022 92/208 |
| 6,357,341 | B1 | 3/2002 | Wantanabe | |
| 6,860,190 | B2 * | 3/2005 | Oversby | F02F 3/00 92/208 |
| 7,302,884 | B2 * | 12/2007 | Donahue | 92/208 |
| 2008/0264376 | A1 | 10/2008 | Braig | |

FOREIGN PATENT DOCUMENTS

| | | | |
|---|---|---|---|
| DE | 19832091 | A1 | 1/1999 |
| GB | 2347194 | A | 8/2000 |
| GB | 2367602 | A | 4/2002 |
| GB | WO2002031336 | A1 | 4/2002 |

* cited by examiner

*Primary Examiner* — Lindsay Low
*Assistant Examiner* — Omar Morales
(74) *Attorney, Agent, or Firm* — Robert L. Stearns; Dickinson Wright, PLLC

(57) ABSTRACT

The invention relates to a piston for an internal combustion engine, having shaft wall sections on the pressure and counter-pressure side, and connecting walls between the shaft wall sections. The connecting walls are arched on the counter-pressure side, and the connecting walls are largely straight on the pressure side, such that the counter-pressure side is more elastic that the pressure side.

5 Claims, 1 Drawing Sheet

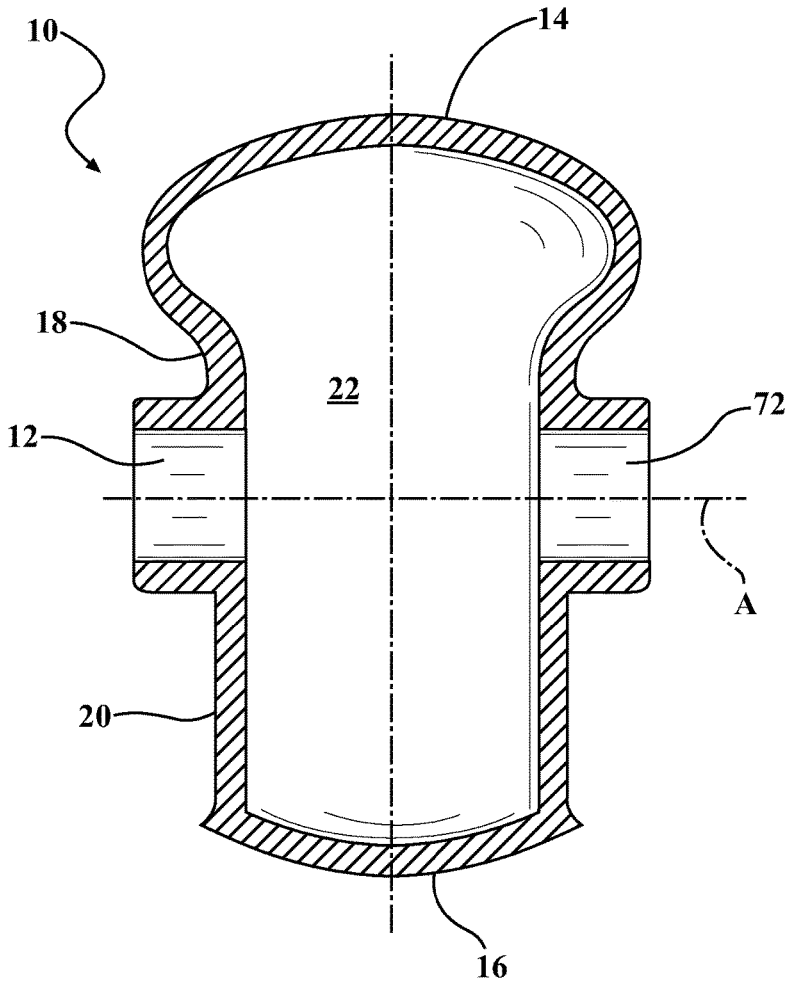
10
14
18
22
72
12
A
20
16

PISTON FOR AN INTERNAL COMBUSTION ENGINE

TECHNICAL FIELD

The invention relates to a piston for an internal combustion engine.

In particular with Otto engines there has recently been an increased trend towards direct injection in association with turbocharging. This leads to constantly increasing cylinder pressures and/or the shift of the occurrence of subjection to maximum lateral forces on the piston shaft towards the range of 20 degrees to 30 degrees after the top dead centre. Furthermore, the requirement for the lowest possible piston noises must always be kept in view.

PRIOR ART

A piston is known from DE 10 2007 020 447 A1. The piston which is known from DE 198 32 091 A1 has shaft wall sections which are called cladding here, and which are larger on the pressure side than on the counter-pressure side.

PRESENTATION OF THE INVENTION

The object forming the basis of the invention is to provide a piston for an internal combustion engine which has an improved combination of load capacity, in particular with the most recent trends in the field of engine development, and the piston noises.

Consequently, the latter has in the first place shaft wall sections on the pressure and counter-pressure side. The shaft wall sections can also be called piston claddings or a piston skirt and essentially constitute sections of the cylinder-shaped surface which corresponds to the inner surface of the cylinder sleeve. However, in those areas where a lateral support is not necessarily required, i.e. in the region of the pin bosses, modern pistons are repositioned so that in the areas required for support on both sides of the piston pin the shaft wall sections described remain. The latter can have a form that changes in the direction of the axis of rotation of the piston. The shaft wall sections described are connected by connecting walls which are essentially produced by repositioning the piston shaft in the region of the pin bosses, and accommodate the pin bosses.

The piston according to the invention includes connecting walls which are arched on the counter-pressure side, and are largely straight on the pressure side. Due to this the counter-pressure side is more elastic than the pressure side. The form on the counter-pressure side can be called a "figure of 8" form and is comparably elastic due to the arching of the connecting walls. This form has an advantageous effect upon noise developments because the piston strikes the counter-pressure side comparably "softly". This reduces the development of noise and is at the same time acceptable with regard to the loading of components because the latter is less on the counter-pressure side than on the pressure side.

A comparably high degree of rigidity is achieved on the pressure side due to the largely straight connecting walls by means of which the shaft wall section is supported on the pressure side. This form can be called a "slipper design", and is advantageously suitable for absorbing the strong lateral forces occurring as a result of the trends described within the framework of engine development.

Furthermore, for a harmonic and durable form of the counter-pressure side the arching of the connecting walls on the counter-pressure side is predominantly in the same direction as the arching of the shaft wall section on the counter-pressure side. In other words, the arched form of the shaft wall section on the counter-pressure side crosses over to harmonically inwardly arched connecting walls at the point at which the shaft wall section is released from the "notional" total cylinder shape and the connecting walls begin. In other words, both the shaft wall section and the connecting walls on the counter-pressure side are concavely arched, as viewed from the inside of the piston. In the region of the cross-over of the connecting walls into the pin bosses an at least slight convex arching can follow, as viewed from the inside of the piston.

By means of the invention the opposing requirements for the absorption of strong lateral forces on the one hand and reduced noise development on the other hand are advantageously combined by the different sides of the piston being designed differently and according to the respective requirements. In particular, it has been highlighted by the initial trials that in this way the piston also fulfils the more stringent requirements as a result of increasing cylinder pressures and/or the described shift of the occurrence of subjection to maximum lateral forces.

In order to establish the desired elasticity on the counter-pressure side it is currently preferred to form the shaft wall section on the counter-pressure side with greater width, at least in some areas, than the shaft wall section on the pressure side.

The described rigid form on the pressure side and the more elastic form on the counter-pressure side can be supported by the wall thickness of the shaft wall section and/or of the connecting walls on the counter-pressure side being reduced, at least in some areas, in relation to the rest of the shaft wall section and/or the other connecting walls, and/or by the wall thickness of the shaft wall section and/or of the connecting walls being increased, at least in some areas, on the pressure side in relation to the rest of the shaft wall section and/or the other connecting walls. In this way one can achieve a further increase in elasticity on the counter-pressure side and/or an increase in rigidity on the pressure side, and this advantageously supports the effect striven for by the invention.

BRIEF DESCRIPTION OF THE DRAWING

In the following an exemplary embodiment illustrated in the drawing is described in greater detail.

The FIGURE shows a cross-section through the piston according to the invention in the region of the pin bosses.

DETAILED DESCRIPTION OF A PREFERRED EMBODIMENT OF THE INVENTION

In FIG. 1 a cross-section, i.e. a section perpendicular to the axis of rotation of the piston 10 according to the invention is shown. The pin bosses 12 and the shaft wall sections 14 and 16 with which the piston is supported in the cylinder sleeve can be seen. In the FIGURE, 14 identifies the shaft wall section on the counter-pressure side, and 16 the shaft wall section on the pressure side. As a comparison of the two sides by means of the FIGURE shows, the shaft wall section 16 on the pressure side is somewhat narrower, i.e. as measured substantially in the direction of the piston pin axis A, than the shaft wall section 14 on the counter-pressure side. Moreover, the connecting walls 18 and 20 of the two sides differ. On the pressure side the connecting walls 20 are largely straight in order to support the shaft wall section 16 on the pressure side as rigidly as possible so that the loads can be absorbed. On the other hand, the connecting walls 18 on the counter-pressure side are arched so that a more elastic form is provided here which is advantageous for the piston noises. With the exemplary embodiment shown, the connecting walls 18 on the counter-pressure side are convexly arched from the pin bosses 12 initially over a short section, as viewed from the inside 22 of the piston, and then pass harmonically into a concave arching followed by the concave arching of the shaft wall section 14 on the counter-pressure side. Furthermore, in the exemplary embodiment shown in FIG. 1, one of the connecting walls 20 on the pressure side is axially aligned (relative to the pin axis A) with one of the connecting walls 18 on the counter-pressure side at the pin boss 12 which spaces those two connecting walls 18 and 20. Each pin boss 12 is formed by a flange surrounding the pin axis A, and the flange extends from the axially aligned connecting walls 18 and 20 along the pin axis A in a direction away from the other pin boss 12, but not in a direction toward the other pin boss 12.

With the exemplary embodiment shown all of the connecting walls 18 are formed such that they accommodate the pin bosses 12 on the inside of the latter, i.e. on the side directed towards the piston interior 22. Furthermore, with the exemplary embodiment shown the shaft wall section 16 extends a little beyond the connecting walls 20 on the outside on the pressure side in order to make available a sufficient area in order to support the piston 10.

The invention claimed is:

1. A piston for an internal combustion engine, having shaft wall sections on pressure and counter-pressure sides of the piston, and connecting walls between the shaft wall sections, the connecting walls on the counter-pressure side being spaced from the connecting walls on the pressure side by pin bosses, the connecting walls being largely straight on the pressure side, the connecting walls on the counter-pressure side being convexly arched from the pin bosses initially over a short section, as viewed from the inside of the piston, and then pass into a concave arching followed by a concave arching of the shaft wall section on the counter-pressure side, such that the counter-pressure side is more elastic than the pressure side, the wall thickness of at least a portion of the shaft wall section and/or at least a portion of the connecting walls being reduced on the counter-pressure side in comparison with the rest of the shaft wall section and/or the rest of the connecting walls, and/or the wall thickness of at least a portion of the shaft wall section and/or at least a portion of the connecting walls being increased on the pressure side in comparison with the rest of the shaft wall section and/or the rest of the connecting walls, and the pin bosses extending outwardly relative to the connecting walls on the pressure and counter-pressure sides.

2. The piston according to claim 1, wherein the shaft wall section on the counter-pressure side is wider, at least in some areas, than the shaft wall section on the pressure side.

3. The piston according to claim 1, wherein one of the connecting walls on the pressure side is axially aligned with one of the connecting walls on the counter-pressure side at the pin boss spacing the connecting walls.

4. The piston according to claim 3, wherein each pin boss is formed by a flange surrounding a pin axis, the flange extends from the axially aligned connecting wall in a direction away from the other pin boss.

5. The piston according to claim 4, wherein the flange extends parallel to the pin axis and does not extend in a direction toward the other pin boss.

* * * * *